US005837370A

United States Patent [19]

Aneja

[11] Patent Number: 5,837,370

[45] Date of Patent: Nov. 17, 1998

[54] FABRICS OF WOOL AND/OR POLYESTER FIBERS

[75] Inventor: Arun Pal Aneja, Greenville, N.C.

[73] Assignee: E.I. du Pont de Nemours and Company, Wilmington, Del.

[21] Appl. No.: 860,527

[22] PCT Filed: Jun. 12, 1997

[86] PCT No.: PCT/US97/08417

§ 371 Date: Jun. 30, 1997

§ 102(e) Date: Jun. 30, 1997

[87] PCT Pub. No.: WO97/02372

PCT Pub. Date: Jan. 23, 1997

Related U.S. Application Data

[63] Continuation-in-part of Ser. No. 662,896, Jun. 12, 1996, abandoned, and Ser. No. 662,804, Jun. 12, 1996, Pat. No. 5,698,319, each is a continuation-in-part of Ser. No.497,495, Jun. 30, 1995, Pat. No. 5,591,523, and Ser. No. 642,650, May 3, 1996, Pat. No. 5,626,961, which is a continuation-in-part of Ser. No. 497,499, Jun. 30, 1995, abandoned.

[51] Int. Cl.[6] ..... D02G 3/00

[52] U.S. Cl. ..... 428/359; 428/397; 428/401; 428/400

[58] Field of Search ..... 428/579, 400, 428/401, 359

[56] References Cited

U.S. PATENT DOCUMENTS

| | | | |
|---|---|---|---|
| 3,632,391 | 1/1972 | Whitfield | 427/393.2 |
| 3,653,955 | 4/1972 | Habib | 427/214 |
| 3,732,684 | 5/1973 | Csok et al. | 57/144 |
| 3,837,022 | 9/1974 | Moore | 428/369 |
| 4,182,682 | 1/1980 | Koerner et al. | 252/8.6 |
| 4,248,590 | 2/1981 | Koerner et al. | 8/128 A |
| 4,405,328 | 9/1983 | Nickel et al. | 8/128 A |
| 4,833,032 | 5/1989 | Reese | 428/364 |
| 4,991,387 | 2/1991 | Tashiro et al. | 57/256 |
| 5,102,930 | 4/1992 | Nakazato et al. | 524/114 |
| 5,236,465 | 8/1993 | Ohashi et al. | 8/128.3 |

FOREIGN PATENT DOCUMENTS

| | | |
|---|---|---|
| Show A 58-208417 | 12/1983 | Japan . |
| Show A 59-192727 | 11/1984 | Japan . |
| 87015670 | 4/1987 | Japan . |
| 2 082 215 | 3/1982 | United Kingdom . |

*Primary Examiner*—Newton Edwards

[57] ABSTRACT

Slickened polyester cut fibers are provided in slivers that are suitable for processing on worsted or woollen system, and provide fabrics of improved aesthetics. The slivers may be of 100% polyester cut fiber or of blends of such fiber with wool, such as are conventionally used in worsted or wool processing from sliver to spun yarn, which is formed into fabrics and garments.

2 Claims, 2 Drawing Sheets

FABRICS OF WOOL AND/OR POLYESTER FIBERS

CROSS-REFERENCE TO RELATED APPLICATION

This is a continuation-in-part of my application Ser. No. 08/662,896 (DP-6460), filed Jun. 12, 1996, now abandoned, and of my application Ser. No. 08/662,804 (DP-6400), now U.S. Pat. No. 5,698,319, also filed Jun. 12, 1996, both being continuations-in-part of my application Ser. Nos. 08/497,495 (DP-6255, now U.S. Pat. No. 5,591,523), filed Jun. 30, 1995, and 08/642,650 (DP-6365-A, now U.S. Pat. No. 5,626,961) filed May 3, 1996 as a continuation-in-part of application Ser. No. 08/497,499 (DP-6365), filed Jun. 30, 1995, and now abandoned, and also derives priority from PCT/U.S. Pat. No. 97/08417, filed Jun. 12, 1997.

This invention relates to improvements in and relating to fabrics of wool and/or of polyester fibers, and relates more particularly to slivers of polyester cut fiber (sometimes referred to as staple) and/or of wool that are suitable for processing on a worsted or woollen system, and to improvements in processes relating thereto and in products therefrom.

In general, how fabrics are "finished" in commercial practice is and has been a closely-guarded secret. It has been suggested in the published art that fabrics be treated with silicones by padding the fabrics or dipping the fabrics in a bath. I have not, however, found any specific teaching of improving woollen/worsted-type fabrics of polyester cut fiber or of polyester/wool blends by applying a silicone slickener specifically to the sliver, as opposed to treating a fabric, so the polyester fibers in the sliver are slickened. Examples of art teachings of applying silicones to wool fabrics include U.S. Pat. No. 5,236,465 (Ohashi et al.), teaching shrink-proofing woollen fabrics by soaking the fabrics first in an aqueous persulfate, drying, and then finishing wih a curable organopolysiloxane and this refers to earlier teaching of treating woollen fabrics with a silicone-based shrink-proof agent; U.S. Pat No. 5,102,930 (Nakazato et al.), teaching shrink-proofing woollen fabrics by soaking them in an aqueous emulsion of specific combinations of organopolysiloxanes; U.S. Pat No. 4,405,328 (Nickel et al.), U.S. Pat No. 4,248,590 (Koerner et al.) and U.S. Pat No. 4,182,682 (Koerner et al.), all teaching shrink-proofing wool fabrics by treating with specific organopolysiloxane compositions; and, similarly, GB 2,082,215 (Wool Development International Limited, Edmonson) teaching imparting shrink-resistance and water-repellency by treating wool fabrics with polysiloxane combinations. An example of such a reference that specifically mentions padding and dipping fabrics of polyester fibers for silicone treatment is JP 87015670 (Toray). As indicated, these all treat fabrics. There was no teaching in these references that precursor polyester slivers should be slickened, instead of the fabrics.

Nihon Ester KK has disclosed in Japanese Patent Applications Publications (KoKai) Nos. Showa 58-208,417 (Dec. 5, 1983) and Showa 59-192,727 (Nov. 1, 1984) mohair-like polyester fibers and spun yarn and a method for manufacturing mohair-like polyester fibers. Such mohair-like polyester fibers had a combination of the following specific requirements: (1) the polyester polymer had to have a "haze value" of no more than 30%, as defined therein; (2) the fibers had to be a uniform blend of 2 or more differing deniers, within a specific dpf range of 2.5 to 8.5, such deniers differing by at least 5 dpf; (3) the fibers had to have a specific number of crimps/25 mm (3 to 8 per 25 mm length) and a crimping ratio of 3 to 10%; and (4) dynamic coefficient friction between the fibers had to be 0.20 to 0.30, which was obtained by treating the precursor filaments in the form of tow with a polysiloxane and/or polyoxyalkylene-type softening and finishing agent and a cross-linking agent before heat-treating and cutting the filaments to give a variable staple length that was desired. Nihon Ester treated their continuous filament tows before heat-treating and cutting their tows to form their "variable staple", i.e., cut polyester fiber of variable fiber length, which was what they desired.

Habib U.S. Pat. No. 3,653,955 (filed May 20, 1968) disclosed antistatic fiber treatments involving applying to the fibers a conductive silicone lubricant composition (see Abstract and col. 2, lines 13 et seq.). Habib's claim 1 refers to loose keratin fibers, claims 6 and 12 to dyed wool top, and claim 11 to keratinous fibers and mixtures of fibers containing at least 10% by weight of keratinous fibers. Col. 2, line 35, states "Synthetic fibers which have been combined with keratinous fibers and successfully treated include polyester fibers such as "DACRON" of E. I. du Pont de Nemours and Company; and "FORTREL" of the Celanese Corporation;" and also mentions polyamides, polyacrylonitrile, polypropylene and polyvinylchloride; and then (at line 42) "The fibers may be treated in any desired form, for example, as loose fibers, filaments, rovings and yarns. For a continuous process, however, it is desirable to have the fibers in rope-like form such as sliver, slubbing, top, roving or yarn." None of Habib's working Examples specified treating a sliver. Most of Habib's Examples described treating wool tops. Habib's Examples 7 and 9 disclosed "DACRON" tows (sold by DuPont) cut on a converter and sprayed with aqueous silicone. The filaments of such polyester tow sold by DuPont in 1968 were of round cross-section.

Polyester fibers are either (1) continuous filaments or (2) fibers that are discontinuous, which latter are often referred to as staple fibers or cut fibers, so a qualifying term, such as "continuous filament", or "staple fiber" or "cut fiber" is often used herein to emphasize the distinction between them. Polyester staple fibers are made by first being formed by extrusion into continuous polyester filaments, which are processed in the form of a tow of continuous polyester filaments before being converted into staple.

Most polyester cut fiber manufactured, used and sold heretofore has been of round cross-section and has been blended with cotton. A typical spun textile yarn is of cotton count 25, and of cross section containing about 140 fibers of 1.5 dpf (denier per filament) and 1.5 inch length. It has been the custom to match dpf and length. Denier is the weight in grams of a 9000 meter length of the fiber and thus a measure in effect of the thickness of the fiber. When one refers to denier, the nominal or average denier is often intended, since there is inevitably variation along-end and end-to-end, i.e., along a filament length and between different filaments, respectively. In general, it has been the objective of fiber producers to achieve as much uniformity as possible in all processing steps along-end and end-to-end so as to produce a polyester fiber of round cross section and of a single denier and of as uniform denier as practical. 1.5 dpf and 1.5 inch length corresponds to 1.7 dtex and almost 4 cm.

Polyester/worsted yarns are different from polyester/cotton yarns, typically being of worsted count 23, and of cross section containing about 60 fibers for single yarn and about 42 fibers for bi-ply yarn, with fibers that have been of 4 dpf and 3.5 inch length (4.4 dtex and almost 9 cm). The yarn count may vary over 55 worsted to 10 worsted, while the denier and length may vary up to about 4.5 (5 dtex and 11.5 cm) and down to about 3 (3.3 dtex and 7.5 cm). It was only relatively recently that the advantages of using synthetic fibers of dpf lower than the corresponding natural fibers (such as wool) have been found practical and/or been recognized. Attempts to provide low dpf polyester fiber for blending with wool on the worsted system were not, however, successful, and required improvement. As the fiber denier had been reduced, the fibers had become harder to process (carding, drafting, gilling, etc.) in the mill. In fact, below a certain fiber denier, the polyester fibers that had previously been tried had proved practically impossible to process, and/or given poor quality fabrics. Thus, for commercially acceptable processing and blending with wool in practice, we had previously found that the fiber denier of such polyester fibers had to be a minimum of about 3 dpf (3.3 dtex). Tows of (nominal) dpf less than 3 were not believed available commercially prior to U.S. Pat. No. 5,591,523 (DP-6255). This was the status previously in the trade. Previously, trying to manipulate a desire to reduce dpf had appeared to be contradictory or incompatible with satisfactory mill processibility.

Processing on the worsted system is entirely different from most practice currently carried out on the cotton system, which generally uses cotton fiber that is sold in bales and that may be mixed with polyester fiber that is primarily staple or cut fiber, that is also sold in compacted bales. In contrast, for processing on their system, worsted operators want to buy a tow of polyester fiber (instead of a compacted bale of cut fiber) so they can convert the tow (which is continuous) into a continuous sliver (a continuous end of discontinuous fibers, referred to hereinafter shortly and generically as "cut fiber") by crush cutting or stretch breaking. This sliver is then processed (as a continuous end) through several stages, i.e., drafting, dyeing, back-washing, gilling, pin-drafting and, generally, finally blending with wool. It is very important, when processing on the worsted system, to maintain the continuity of the sliver. Also, however, it is important to be able to maintain reasonably satisfactory processing speed for the sliver.

According to the present invention, there is provided an improvement in a method of providing fabrics of wool fibers and/or of polyester cut fibers with a slickener, wherein the polyester fibers are of average denier per filament about 0.7 to about 4.5, of cut length about 3 to about 4.5 inches, and of scalloped-oval cross-section, wherein the improvement is characterized in that a sliver of polyester cut fibers and/or of wool fibers is treated with the slickener, and wherein said sliver is suitable for processing on a worsted or woollen system.

According to the invention, there is also provided a sliver of polyester cut fibers or of a blend of polyester cut fibers and wool fibers, wherein the polyester fibers are of average denier per filament about 0.7 to about 4.5, preferably about 0.7 to about 2, of cut length about 3 to about 4.5 inches, and of scalloped-oval cross-section, wherein said sliver is suitable for processing on a worsted or woollen system, and wherein said sliver is slickened. The slickener is preferably a silicone slickener.

There are also provided, according to the invention, improvements as described hereinafter, including processes relating thereto and products therefrom.

DETAILED DESCRIPTION OF INVENTION

Figure 1:
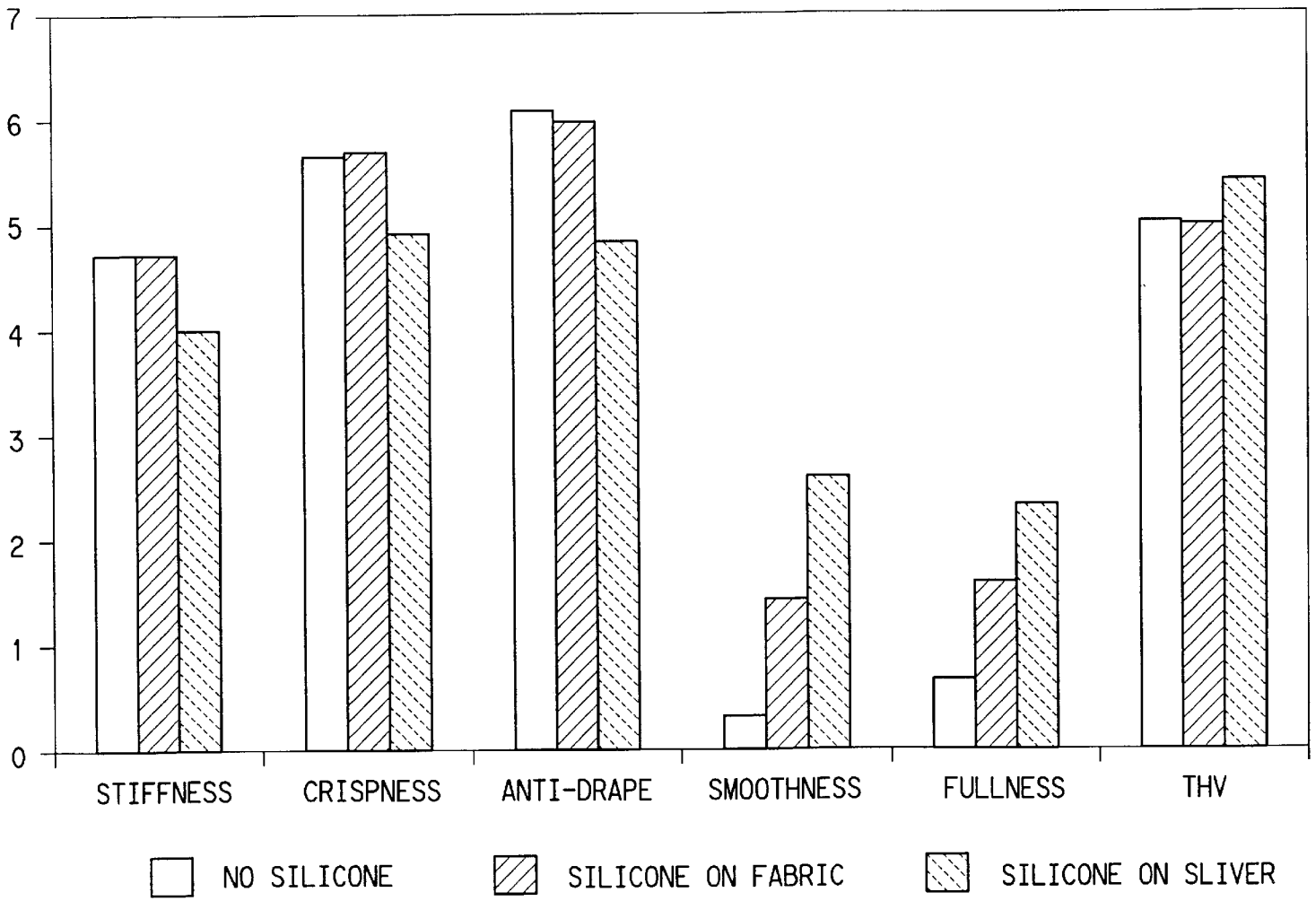
FIGS. 1–2 show comparisons of above characteristics evaluated by the Kawabata Evaluation System for Fabrics, as discussed in the Examples hereinafter.

As indicated, processing on the worsted system is entirely different from most processing on the cotton system. Details of preparing polyester tows and slivers and their processing on the worsted or woollen system are explained in U.S. Pat. No. 5,591,523 (DP-6255) and copending application Ser. Nos. 08/642,650 (DP-6365-A), and 08/662,804 (DP-6400), corresponding, respectively, to WO 97/02372, WO 97/02373, and WO 97/02374, and in the art, and further explanation would be redundant as the essence of the present invention is the treatment of slivers with a slickener, preferably a silicone slickener, instead of applying the slickener to the actual fabrics, or to continuous filamentary tows that are precursors to polyester slivers of cut fibers. This provides advantages, as will be described and illustrated in the Examples hereinafter.

We have used the term "slickening" because of acquaintance with polyester fiberfill, which is a filling material used in filled articles, such as pillows, quilts, furnishings and the like. This is an entirely separate field from processing on the worsted or woollen system to make spun yarns of polyester fibers, often blended with wool. Examples of references to slickening of polyester fiberfill are, e.g., in Hoffman, U.S. Pat. No. 3,271,189, Mead et al., U.S. Pat. No. 3,454,422, and in various patents from Marcus, e.g., U.S. Pat. No. 4,618,531.

As indicated, the essence of the present invention is that we slicken slivers. The advantages of slickening the slivers over treating fabrics with the same silicones is demonstrated in the Examples hereinafter. The advantage of slickening a sliver as opposed to a continuous filamentary tow is demonstrated hereinafter in a Comparative Test.

Examples of suitable silicone slickeners are given in the Examples and in the art referred to. Several non-Si-slickener materials are also disclosed in the literature. These could be nonreactive dimethyl and the reactive amino modified and epoxy functional compounds. Preferred materials are "curable" to the polyester fiber. For instance, a segmented copolymer ox poly(ethylene terephthalate) and poly (ethylene oxide). Some such materials are available commercially, such as the textile finishing agent sold under the trademark "ATLAS" G-7264 by ICI Specialty Chemicals, Brussels, but it may be preferred to use materials with less fiber-to-metal friction, as well as a low fiber-to-fiber friction. Another material is sold as "ZELCON" 4780, by E. I. du Pont de Nemours and Company. Other materials are disclosed in Raynolds U.S. Pat. No. 3,981,807. Several segmented copolyesters consisting essentially of poly (ethylene terephthalate) segments and of poly(alkylene oxide) segments, derived from a poly(oxyalkylene) having a molecular weight of 300 to 6,000 and dispersions thereof are disclosed in McIntyre, et al., U.S. Pat. Nos. 3,416,952, 3,557,039 and 3,619,269, and in various other patent specifications disclosing like segmented copolymers containing poly(ethylene terephthalate) segments and poly(alkylene oxide) segments. Generally the poly(alkylene oxide) will be a poly(ethylene oxide), which is a matter of commercial convenience. Other suitable materials include modified poly (ethylene oxide)/poly(-propylene oxide) grafted with functional groups to permit cross-linking, e.g., by treatment with citric acid, such as are available commercially from Union Carbide as "UCON" 3207A or the amino silicone polymer emulsion available commercially from Ciba-Geigy as ULTRATEX. Other materials that may include particularly useful compositions are disclosed in Teijin EP 159882 and in ICI Americas EP 66944. Choice of a particular slickener will depend on the desired end use, and many of the indicated slickeners differ in their ability to lubricate, e.g., to lower fiber-to-fiber and/or fiber-to-metal frictions and amounts of anion groups. If, for example, moisture transport and durability are desired, but softness is not so important, item 12 in EP 66944 may be desirable. Depending on the aesthetics desired, the amount of slickener may be adjusted, between about 0.05 and about 1%, preferably about 0.15 to about 0.5%, on the weight of the fiber, being generally desirable, depending on, e.g., the type of slickener and the effect desired.

EXAMPLES

The invention is further illustrated in the following Examples, which, for convenience, refer to processing on the worsted system, which is generally more important, but the invention could also be applied to processing on a woollen system. All parts and percentages are by weight unless otherwise indicated. "B/A" indicates the ratio of the maximum width of the cross-section (B) to the length of preferred (scalloped)-oval cross-section of the filaments. Most test procedures are well known and/or described in the art. For avoidance of doubt, the following explanation of procedures that were used are given in the following paragraphs.

The sample silicon (Si) is determined quantitatively by measuring the silicon x-ray fluorescence intensity from a pressed sample pellet using x-ray vacuum fluorescence spectrometer (Instrument: Phillips 1450). A 2.5 gm sample is pressed into a pellet in a cold press (Angstrom Press). The sample is then placed in a holder and pressed again for 10 sec. at conditions of 10,000 psi and 200° C. It is cooled for 5 minutes and put in a helium x-ray sample cut for analysis. The measurement is done on both sides of the sample and average result is recorded.

The objective evaluation of the fabric quality was conducted/measured on the Kawabata Evaluation System for Fabrics (KESF). There is available commercially an integrated system for the measurement of fabric mechanical and surface properties. This equipment is designed to measure low stress tensile, bending, shear and lateral compression properties of fabrics, as well as fabric surface friction and surface topography (Reference: S. Kawabata, "The Standardization and Analysis of Hand Evaluation, 2nd Edition." The Textile Machinery Society of Japan, 1980). A series of expressions are developed which relate the components of fabric handle called the "Primary Hand Values (PHV)" (stiffness, crispness, anti-drape, smoothness, and fullness) and fabric mechanical and surface properties. Expressions are also developed for the overall fabric handle rating called the "Total Hand Value" (THV) from the Primary Hand Values. The KESF data is used for analysis of fabrics.

EXAMPLE I

Filaments of poly(ethylene terephthalate) of mixed dpf (approximately 50% by weight being 4.1 dpf, 50% by weight being of 9.7 dpf) were melt-spun at 282° C. from polymer containing 0.40 weight percent tetraethyl silicate (as described in Mead, et al., U.S. Pat. No. 3,335,211) and having a relative viscosity of 10.1 (determined from a solution of 80 mg of polymer in 10 ml of hexafluoroisopropanol solvent at 25° C.). The polymer was extruded at a rate of 90 lbs./hr. per position from 44 positions in all. 22 positions, with 11 positions on one side of machine and 11 positions on the other, produced the low denier (4.1) filaments. 22 positions, with 11 positions on one side and 11 positions on the other, produced the heavy denier (9.7) filaments. The orifice shape for each of the spinneret capillaries was three diamonds joined together as described and illustrated in my copending application Ser. No. 08/662,804 (DP-6400), filed Jun. 12, 1996, to give filaments of scalloped-oval cross section as described by Gorrafa U.S. Pat. No. 3,914,488. The smaller filaments were spun from a spinneret containing 1054 capillaries while larger filaments were spun from a spinneret containing 450 capillaries. All these filaments were spun at a withdrawal speed of 1600 ypm and quenched using radially-directed air from a profiled quench system, as described in Anderson, et al., U.S. Pat. No. 5,219,582. The spun tow was collected in a can and consisted of a mixture of lower and higher denier filaments of total denier approximately 191,101, and total number of filaments 33,088. The as-spun filament properties are indicated in Table 1A.

TABLE 1A

| | Conc. % | DPF | Mod gpd | Ten gpd | Elong % | B/A |
|---|---|---|---|---|---|---|
| Higher dpf | 50 | 9.7 | 17 | 0.8 | 287 | 0.66 |
| Lower dpf | 50 | 4.1 | 19 | 1.0 | 289 | 0.68 |

Fourteen cans of spun supply were combined together to give a tow amounting to 463,232 filaments and of total denier approximately 2.7 million. This tow was-drawn at a draw ratio of 3.0× in 95° C. spray draw of water. The tow was then passed through a stuffer box crimper and subsequently relaxed at 130° C. to give a final tow of total denier approximately 849,000 of average denier about 2.56 dpf, and containing filaments of both lower and higher denier. The drawn properties are listed in Table 1B.

TABLE 1B

| | Conc. % | DPF | Mod gpd | Ten gpd | Elong % | CPI | B/A |
|---|---|---|---|---|---|---|---|
| Higher dpf | 50 | 3.7 | 37 | 2.4 | 31 | 8.0 | 0.57 |
| Lower dpf | 50 | 1.5 | 45 | 2.9 | 35 | 9.6 | 0.5 |

A conventional finish was applied to provide a finish level on the fiber of 0.15% by weight. The effective/nominal denier per filament (i.e., the denier of the total tow bundle divided by the number of filaments) was 2.56 dpf, about 50% of the filaments (by weight), however, being of 1.5 denier and the remaining 50% being of 3.7 denier. The tow was collected in a conventional tow box and sent to a mill for downstream processing, blending with wool, yarn and fabric conversion.

The mixed denier tow was crush-cut to form a continuous sliver of average fiber length 3.5 inches. The sliver was then dyed. The sliver was then treated with durable silicone elastomer finish labeled wet-on-wet application. A 0.25% concentration of amino methyl polysiloxane copolymer of a 20% aqueous emulsion was made in a water bath at room temperature. The sliver was processed at a rate of 5–10 lbs./hr. through the bath and dried in an oven at 275°–300° F. for 5 minutes to cure the silicone. This was followed by pin drafting, gilling and blending with wool. The sliver was made into yarn which was woven into fabric with resultant 0.23% silicone according to the invention.

The fabric prepared from the slickened sliver of the invention had superior handle characteristics as measured by the Kawabata Evaluation System for Fabrics than either the untreated fabric or as compared to fabric that had been treated by application of the same silicone to the fabric by padding (dry-on-dry), spraying or dipping. This was surprising since the quantity of silicone elastomer finish applied was similar.

All fabrics were of plain weave construction with a warp count of double 50s and fill of single 35s. The warp direction had 60 ends/inch while the fill direction has 53 ends/inch. The fabric thickness was 0.011 inch, weight of 1.45 oz./sq. yd. and bulk of 1.91 cc/gm. Table 1C below lists the properties of all three types of fabrics compared in the Example.

TABLE 1C

| | Silicone on Sliver | No Silicone | Silicone on Fabric |
|---|---|---|---|
| Warp Count | 2/50-17Zx15S | 2/50-17Zx15S | 2/50-17Zx15S |
| Fill Count | 1/35-17S | 1/35-17S | 1/35-17S |
| Ends/Inch: | | | |
| Warp | 60 | 59 | 59 |
| Fill | 53 | 52 | 53 |
| Thickness (In.) | 0.011 | 0.011 | 0.011 |
| Weight, oz./sq/yd. | 1.4928 | 1.4511 | 1.432 |
| Bulk, cc/g | 1.90 | 1.95 | 1.91 |

As seen in FIG. 1 and in Table 1D, the fabric prepared according to the invention ("Silicone on Sliver") was superior in all the primary hand value parameters of fullness (high), smoothness (high), crispness (low), stiffness (low), and anti-drape (low) of importance in the textile, e.g., suiting market and also the overall handle of the fabric as measured by "Total Hand Value". This objective analysis was confirmed by an independent panel of judges with their subjective evaluation.

TABLE 1D

| | KESF Properties | | | | | |
|---|---|---|---|---|---|---|
| Type of Treatment | Fullness | Smooth-ness | Crisp-ness | Stiff-ness | Drape | Fabric Handle |
| Si on Sliver | Best | Best | Best | Best | Best | Best |
| No silicone | Good | Good | Better | Good | Good | Good |
| Si on Fabric | Better | Better | Good | Good | Better | Better |

EXAMPLE II

This Example was carried out essentially as described in Example 1, except that the silicone was applied after blending the polyester sliver with wool. In this wet-on-dry application technique, a 0.25% concentration aqueous emulsion was sprayed at room temperature on the polyester/wool blend sliver. The sliver was pin-drafted, gilled, dyed, and converted into yarn. The fabric prepared according to the invention (Si on Sliver) indicated superior handle characteristics.

EXAMPLE III

In Table 3, data are summarized for fibers spun essentially as described by procedure in Example I, except that the relative proportions of light and heavy fibers and the total effective denier were varied, in items 2 (60 large/40 small) and 3 (50/50), whereas in items 1 and 4 scalloped-oval filaments were spun all (100%) being of the same dpf, and in item 5, all the filaments were of round cross-section. These slivers were made into yarns which were converted into fabrics as described in Example I, with resultant 0.23–0.25% silicone. The resulting fabrics prepared according to the invention had superior handle characteristics in contrast to either fabrics from untreated slivers or fabrics that had been treated by application of the silicone to the fabric.

TABLE 3

| | Thruput/ | | No. | Spun Properties | | | | |
|---|---|---|---|---|---|---|---|---|
| No. | End Lbs/Hr. | No. Cap Per End | Spin Pos | DPF | Mod gpd | Ten gpd | $E_B$ % | B/A |
| 1 | 70 | 1054 | 48 | 3.1 | 17 | 1.1 | 315 | 0.61 |
| 2 | 70 | 711 | 29 | 4.6 | 18 | 1.0 | 326 | 0.67 |
| | 70 | 1054 | 19 | 3.1 | 18 | 1.1 | 339 | 0.64 |
| 3 | 70 | 450 | 24 | 7.3 | 18 | 1.0 | 331 | 0.66 |
| | 70 | 1054 | 24 | 3.1 | 16 | 1.0 | 301 | 0.62 |
| 4 | 73.8 | 450 | 48 | 7.5 | 16 | 1.0 | 347 | 0.64 |
| 5 | 93.5 | 520 | 41 | 6.91 | 18 | 1.0 | 350 | — |

| | Thruput | | No. | Drawn Properties | | | | | | |
|---|---|---|---|---|---|---|---|---|---|---|
| No. | End Lbs/Hr. | No. Cap Per End | Spin Pos | DPF | Mod gpd | Ten gpd | $E_B$ % | CPI | B/A | Si (%) |
| 1 | 70 | 1054 | 48 | 1.2 | 43 | 3.0 | 20 | 7.8 | 0.66 | 0.25 |
| 2 | 70 | 711 | 29 | 1.8 | 46 | 2.8 | 49 | 9.24 | 0.69 | 0.25 |
| | 70 | 1054 | 19 | 1.2 | 42 | 2.9 | 41 | 9.24 | 0.64 | |
| 3 | 70 | 450 | 24 | 2.7 | 39 | 2.5 | 28 | 10.1 | 0.65 | 0.25 |
| | 70 | 1054 | 24 | 1.2 | 38 | 2.9 | 30 | 10.1 | 0.68 | |
| 4 | 73.8 | 450 | 48 | 2.86 | 41 | 2.6 | 33 | 8.7 | 0.64 | 0.23 |
| 5 | 93.5 | 520 | 41 | 3.0 | 40 | 2.1 | 16.5 | 8.3 | — | 0.25 |

EXAMPLE IV

Figure 2:
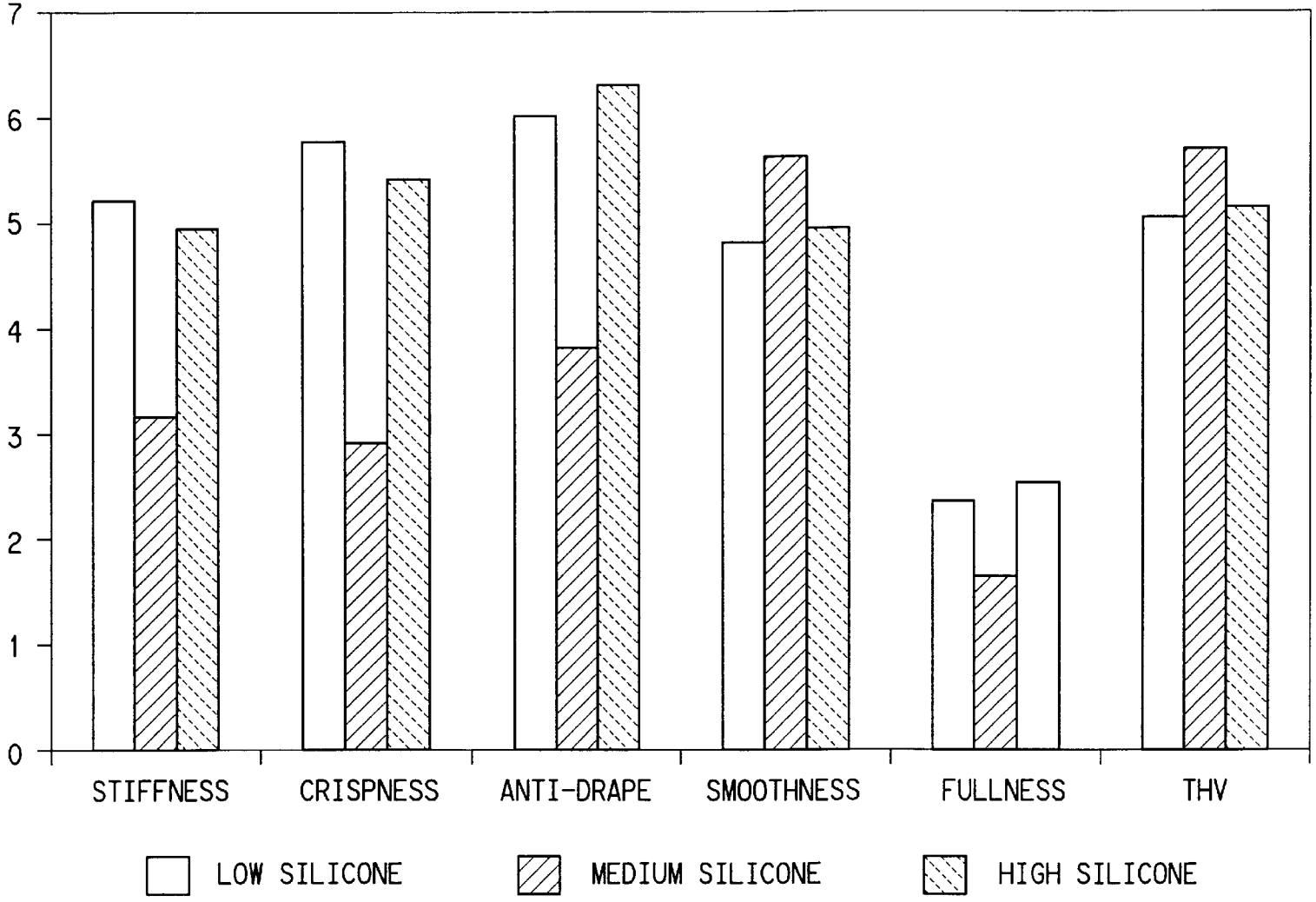

This Example was carried out essentially as described in Example III, except that the amounts of silicone applied to the sliver were varied. Each sliver was treated in a bath containing either 0.125%, 0.25% or 0.43% concentration of amino methyl polysiloxane copolymer of a 20% aqueous emulsion in a water bath at room temperature. The resulting slivers treated with different concentrations of silicone were made into yarns which were converted into fabrics as in Example 1. The resultant silicone on fabric amounts were 0.25%, 0.26% and 0.27%, respectively, despite the larger differences in concentration applied. The fabrics were evaluated for primary hand values and overall handle as before and showed good properties as can be seen in FIG. 2, where the "low", "medium" and "high" indicate concentrations of silicone in the baths, the medium concentration (providing 0.26% by weight silicone in the fabric) apparently giving best results in this test under these conditions.

EXAMPLE V

A mixed dpf tow of filaments of poly(ethylene terephthalate) in a mixture of approximately 80% by weight of 3.1 dpf and 20% by weight of 7.2 dpf was prepared by melt spinning (from polymer containing 0.58 weight percent tetra ethyl silicate and having a relative viscosity of 8.9) essentially as described in Example I, except that 38 positions, with 19 positions on one side of the machine and 19 positions on the other side, produced the lower denier filaments and 10 positions, with 5 positions on one side and 5 on the other side, produced the higher denier filaments. The spun tow collected in a can had a total denier of approximately 157,000. As-spun properties are indicated in Table 5A.

TABLE 5A

| | Conc. % | DPF | Mod gpd | Ten gpd | Elong % | B/A |
|---|---|---|---|---|---|---|
| Higher dpf | 20 | 7.2 | 21 | 0.9 | 303 | 0.65 |
| Lower dpf | 80 | 3.1 | 22 | 1.0 | 195 | 0.64 |

Fifteen cans of spun supply were combined together for a total tow denier of approximately 2.2 million, that was drawn, crimped, and relaxed essentially as described in Example 1 to give a final tow size of approximately 900,000 denier. The resulting properties are listed in Table 5B.

TABLE 5B

| | Conc. % | DPF | Mod gpd | Ten gpd | Elong % | CPI | B/A |
|---|---|---|---|---|---|---|---|
| Higher dpf | 20 | 2.9 | 51.3 | 2.49 | 14.78 | 7.56 | 0.65 |
| Lower dpf | 80 | 1.2 | 65.4 | 2.86 | 8.76 | 8.76 | 0.64 |

Conventional finish was applied as in Example I. The effective/nominal denier was 1.5 dpf, about 20% of the filaments being of 2.9 dpf and 80% being 1.2 dpf. The tow was collected in a conventional tow box and sent to a mill for downstream processing.

In the mill the 900,000 denier tow was stretch-broken on a Seydel machine at approximately 225 ypm. The average fiber length was approximately 3.5 inches. The sliver was then blended with wool. This Example was carried out with silicone finish being applied to wool prior to blending with polyester sliver. In this application technique, 0.25% concentration of amino methyl polysiloxane copolymer of a 20% aqueous emulsion was sprayed at room temperature on wool which was subsequently blended with stretch-broken polyester sliver. In other words, in this Example, the sliver of wool blended with polyester cut fiber had silicone, even though the precursor sliver of only polyester cut fiber did not itself have any silicone applied before blending with wool. The polyester/wool blend sliver was pin-drafted, gilled, converted into yarn, which was then dyed and woven into fabric, essentially as in Example I. The resulting fabric obtained from this yarn according to the invention indicated superior handle characteristics as contrasted with fabric made from a blended sliver that had no silicone.

As has been shown in the foregoing Examples, several different processes have been demonstrated for ensuring that the slickener is appropriately applied to the polyester fibers in the slivers of the invention. The sliver itself may be treated with the slickener, e.g., by dipping or passing the sliver through a bath containing the slickener. If, however, the slickener is applied further upstream to a tow of polyester continuous filaments before conversion of the continuous filamentary tow to the sliver of cut polyester fiber, it has proved too difficult in practice to convert the tows into cut fiber of uniform fiber length. This is because the slickened tows have not given as good results as unslickened tows, the slickened tows having given longer fiber lengths and inferior length distributions, bundle breaks and fluff breaks which are all serious disadvantages. Some of this is shown in the following comparative test.

COMPARATIVE TEST

Such polyester filament tows of total denier about 70,000 (about 78,000 dtex) were stretch-broken to form slivers of "cut fiber" on an experimental machine for comparative purposes. One tow was slickened with 0.1% silicone on the weight of the filaments by passing through an aqueous bath containing 2.5% by weight of the silicone and then dried in an oven to cure the silicone on the filaments (essentially as described in Example 1). The other tow was not slickened. After stretch-breaking, the length distributions of the resulting fibers were measured on a WIRA Fiber Diagram, which showed inferior length distribution and an average fiber length of 4.5 inches (about 11.5 cm) for the slickened tow, which is much too high and undesirable, in contrast to superior length distribution and an average fiber length, as desired, of 3.8 inches (about 9.5 cm) for the unslickened tow. As will be recognized, these small experimental tows (only 70,000 denier) were an order of magnitude smaller than commercial tows (several million denier). It has proved impracticable to use slickened tows of such larger denier, as would be required for a commercial operation. This conclusion is reinforced by reading the Nihon Ester teaching of making mohair-like polyester fibers, referred to hereinabove.

Slivers of the invention may be 100% polyester cut fiber, or may be blends of polyester cut fiber and of natural fiber (such as wool). Indeed, as demonstrated in Example V, the slickener has been applied successfully to the wool, by spraying on the wool before the wool was blended with the polyester (stretch-broken, i.e., cut) fiber. These different techniques according to the invention, surprisingly, gave fabrics that had better aesthetics than fabrics that had been treated with the same slickener in fabric form. While the invention is not limited to any theory, it should be noted that, when a woven fabric is treated, for example, as taught by the art, the cut fibers are tightly twisted into spun yarns that are woven into the fabric. In contrast, if the fibers are treated in the form of a sliver (a continuous strand of discontinuous fibers) according to the invention, the slickener is probably better able to penetrate between the fibers and so may probably be better able to lubricate more of the surfaces of the individual fibers than when applied to a fabric that is comprised of spun yarns of fibers twisted tightly together. If this is correct, logically, one would expect that application of other treatments to staple (cut) fibers upstream of forming a spun yarn would also prove more effective than treatment in fabric or spun yarn form; for instance, slickening of wool tows, even if no polyester fiber is blended with the wool, may well be more effective than treating a wool fabric with the same amount of slickener, while recognizing that wool, being a natural fiber, may not generally require a slickening treatment.

The proportions of wool and polyester in blends has varied over the years, according to fashion and the particular desired end-use. Slivers of 55% polyester/45% wool blends have been made according to the present invention, but it seems likely that other proportions, such as 45%/55%, 80%/20% or even down to 30%/70% polyester/wool could be used. Of course, as indicated, 100% polyester slivers have also been made according to the invention.

As indicated, "slickener" is the term that has been used for slickening fiberfill (a different field from that of the present invention) so has naturally been used in the present application, and various slickeners have been suggested in the art, including the art referred to hereinabove. Silicone slickeners have always been preferred for commercial and practical purposes, but non-Si-containing slickeners have also been suggested and used in the fiberfill art, e.g., as mentioned by Marcus in U.S. Pat. No. 4,818,599, and in the art referred to therein and elsewhere, for the reasons mentioned in the art.

I claim:

1. A sliver of polyester cut fibers, comprising polyester fibers having an average denier per filament about 0.7 to about 4.5, of cut length about 3 to about 4.5 inches, and of scalloped-oval cross-section, wherein said sliver is suitable for processing on a worsted or woollen system, and wherein said sliver is slickened.

2. A blend of polyester cut fibers and wool fibers, comprising polyester fibers having an average denier per filament about 0.7 to about 4.5, of cut length about 3 to about 4.5 inches, and of scalloped-oval cross-section, wherein said sliver is suitable for processing on a worsted or woollen system, and wherein said sliver is slickened.

* * * * *